US012187973B2

(12) United States Patent
De Feo et al.

(10) Patent No.: US 12,187,973 B2
(45) Date of Patent: Jan. 7, 2025

(54) LUBRICATING COMPOSITION TO PREVENT CORROSION AND/OR TRIBOCORROSION OF METALLIC PARTS IN AN ENGINE

(71) Applicant: TOTALENERGIES ONETECH, Courbevoie (FR)

(72) Inventors: Modestino De Feo, Solaize (FR); Stephen Derek Rodgers, Durham (GB)

(73) Assignee: TOTALENERGIES ONETECH, Courbevoie (FR)

( * ) Notice: Subject to any disclaimer, the term of this patent is extended or adjusted under 35 U.S.C. 154(b) by 0 days.

(21) Appl. No.: 18/267,351

(22) PCT Filed: Dec. 10, 2021

(86) PCT No.: PCT/EP2021/085254

§ 371 (c)(1),
(2) Date: Jun. 14, 2023

(87) PCT Pub. No.: WO2022/128802

PCT Pub. Date: Jun. 23, 2022

(65) Prior Publication Data

US 2024/0076571 A1 Mar. 7, 2024

(30) Foreign Application Priority Data

Dec. 15, 2020 (EP) ..... 20214198

(51) Int. Cl.

| | |
|---|---|
| ***C10M 137/04*** | (2006.01) |
| ***C10M 101/02*** | (2006.01) |
| ***C10M 169/04*** | (2006.01) |
| *C10N 30/04* | (2006.01) |
| *C10N 30/12* | (2006.01) |
| *C10N 40/26* | (2006.01) |

(52) U.S. Cl.
CPC ..... *C10M 137/04* (2013.01); *C10M 101/02* (2013.01); *C10M 169/04* (2013.01); *C10M 2223/04* (2013.01); *C10N 2030/04* (2013.01); *C10N 2030/12* (2013.01); *C10N 2040/26* (2013.01)

(58) Field of Classification Search
CPC ..... C10M 137/04; C10M 101/02; C10M 169/04; C10M 2223/04; C10N 2030/04; C10N 2030/12; C10N 2040/26
USPC ..... 508/433; 252/389.23
See application file for complete search history.

(56) References Cited

U.S. PATENT DOCUMENTS

| | | | | |
|---|---|---|---|---|
| 4,493,780 | A * | 1/1985 | Schwartz | C23F 11/126 252/75 |
| 4,684,475 | A * | 8/1987 | Matulewicz | C09K 5/20 252/75 |
| 4,689,200 | A * | 8/1987 | Cook | C10M 173/02 987/168 |
| 5,414,103 | A * | 5/1995 | Cracknell | C10M 137/06 558/158 |
| 9,228,148 | B2 * | 1/2016 | Hüffer | C10M 105/74 |
| 2002/0006880 | A1 * | 1/2002 | Guillement | C10M 135/26 508/438 |
| 2003/0087770 | A1 | 5/2003 | Oelscher et al. | |
| 2003/0176299 | A1 * | 9/2003 | Guillemet | C10M 141/10 508/438 |
| 2004/0121918 | A1 * | 6/2004 | Rea | C10M 169/048 508/438 |
| 2007/0087944 | A1 * | 4/2007 | Phillips | C10M 141/10 508/433 |

FOREIGN PATENT DOCUMENTS

| | | |
|---|---|---|
| EP | 3 473 695 A1 | 4/2019 |
| FR | 1 418 688 A | 11/1965 |

OTHER PUBLICATIONS

Apr. 7, 2022 International Search Report issued in International Patent Application No. PCT/EP2021/085254.
Apr. 7, 2022 Written Opinion of the International Searching Authority issued in International Patent Application No. PCT/EP2021/085254.

* cited by examiner

*Primary Examiner* — Ellen M McAvoy
(74) *Attorney, Agent, or Firm* — Oliff PLC

(57) ABSTRACT

A lubricant composition including: from 70 to 99.99% of at least one base oil and from 0.01 to 30% of at least one alcohol ethoxylated phosphate ester compound of formula (I):

(I)

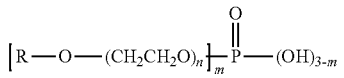

wherein R is a linear or branched alkyl group having from 10 to 14 carbon atoms, m is an integer from 1 to 3, preferably from 1 to 2, n is an integer superior or equal to 6. Also, the use of the compound of formula (I) to prevent and/or reduce and/or limit and/or delay corrosion and/or tribocorrosion of the metal parts of a combustion engine.

15 Claims, No Drawings

LUBRICATING COMPOSITION TO PREVENT CORROSION AND/OR TRIBOCORROSION OF METALLIC PARTS IN AN ENGINE

The invention relates to new lubricant compositions, in particular lubricant compositions for use in an engine, notably a marine engine. These lubricant compositions are particularly useful for preventing corrosion and/or tribocorrosion of metal parts in an engine, and in particular in a two-stroke engine, such as a two-stroke marine engine. The present invention also relates to a method for passivating metal parts of an engine, in particular a two-stroke engine, such as a two-stroke marine engine.

STATE OF THE ART

The primary function of lubricants is to decrease friction. Frequently, however, lubricating oils need additional properties, such as oxidation and corrosion resistance, to be used effectively. For example, lubricants used in large diesel engines, such as, for example, marine diesel engines, are often subjected to operating conditions requiring special considerations.

The marine oils used in low-speed two-stroke crosshead engines are of two types. On the one hand, cylinder oils ensuring the lubrication of the cylinder-piston assembly and, on the other hand, system oils ensuring the lubrication of all the moving parts apart from the cylinder-piston assembly. Within the cylinder-piston assembly, the combustion residues containing acid gases are in contact with the lubricating oil.

Because the working conditions of marine diesel engines are more severe than those of land diesel engines, the sulfur content of fuel is generally higher. Lubricants used in the crankcases of marine engines, are often subjected to operating conditions requiring protection against corrosion. Various additives have been used to improve the rust and corrosion inhibition of lubricant compositions.

Since 2011, environmental concerns have led to new regulations to limit emissions from marine engines. These emissions are due to the combustion of marine fuels with high sulfur content and contribute to air pollution in the form of sulfur dioxide and particulate (dust) emissions that harm human health and the environment. Corrosion in engines is one of the causes of particulate emission problems. The presence of excessive corrosion, even uncontrolled corrosion, becomes preponderant when the engines are operated at very low load (25% and less of the maximum load). This excessive corrosion is also present with the latest existing engine designs because they are more and more severe. Even if in the near future, the sulfur levels of fuels for marine engines will be lowered in order to comply with regulations regarding $SO_x$ emissions, the problem of corrosion remains unresolved for many engine operators and more particularly for two-stroke engines.

The acid gases are formed from the combustion of the fuel oils; these are in particular sulphur oxides ($SO_2$, $SO_3$), which are hydrolyzed in contact with the moisture present in the combustion gases and/or in the oil. This hydrolysis generates *sulphurous* ($HSO_3$) or sulphuric ($H_2SO_4$) acid. These acids tend to condense in the engine, so they can corrode the metal or wipe out major parts such as joints or lining parts. Other acids, such as nitric acid, compounds carrying one or more carboxylic acid functions, or combinations of these acids, can also be responsible for corrosion and/or tribocorrosion of engine parts.

Acid corrosion occurs in the tribological system in the segment-piston-liner zone. In this area, on a lubricated engine, the friction observed is of the reciprocating slip type.

When the engine is running, the cylinder oil is spread on the cylinder and forms a thin, oily film between the piston and the cylinder wall. This film operates three functions:

- it ensures separation between the two surfaces to avoid adhesion wear,
- it neutralizes the drops of sulfuric acid formed in the combustion chamber before they reach the cylinder and cause its wear by corrosion and/or tribocorrosion, and
- it disperses any deposit that may form on each surface in order to keep them clean.

The lubricant compositions for engines, and in particular for marine engines, currently used, include a base oil to which dispersants and overbased detergents are added. In order to ensure this protection, the lubricant compositions used must be sufficiently basic (in particular to neutralize the acid), which implies using large amounts of detergents in these compositions.

An oil's neutralization capacity is measured by its BN or Base Number, characterized by its basicity. It is measured according to standard ASTM D-2896 and is expressed as an equivalent in milligrams of potash per gram of oil (also called "mg of KOH/g" or "BN point"). The BN is a standard criterion making it possible to adjust the basicity of the cylinder oils to the sulphur content of the fuel oil used, in order to be able to neutralize all of the sulphur contained in the fuel, and capable of being converted to sulphuric acid by combustion and hydrolysis.

Thus, the higher the sulphur content of a marine fuel oil, the higher the BN of the oil needs to be.

This basicity is generally provided by detergents that are neutral and/or overbased by insoluble metallic salts, in particular metallic carbonates. The detergents, mainly of anionic type, are for example metallic soaps of salicylate, phenate, sulphonate, carboxylate type etc, which form micelles where the particles of insoluble metallic salts are maintained in suspension. The usual neutral detergents intrinsically have a BN typically less than 150 mg KOH per gram of detergent and the usual overbased detergents intrinsically have a BN in a standard fashion comprised between 150 and 700 mg KOH per gram of detergent. Their percentage by weight in the lubricant composition is selected as a function of the desired BN level.

Currently, in the presence of fuel oils with a high sulphur content (3.5% w/w and less), marine lubricants having a BN from 70 to 140 are used. In the presence of fuel oils with a low sulphur content (0.5% w/w), marine lubricants having a BN from 10 to 70 are used. In these two cases, a sufficient neutralizing capacity is achieved as the necessary concentration in basic sites provided by the neutral and/or the overbased detergents of the marine lubricant is reached.

The overbased detergents generally include a core of calcium carbonate $CaCO_3$ coated with a layer of surfactant. Calcium carbonate reacts with sulfuric acid to form, among others, calcium sulfate ($CaSO_4$). The drop in sulfuric acid in the medium provides protection of the engine parts against corrosion and/or tribocorrosion.

However, the increase in the amount of detergents in lubricating compositions leads to an increase in the number of particles of $CaCO_3$ and $CaSO_4$, which are responsible for the wear of the surfaces by polishing (or abrasive wear) of the metallic parts of the engine, and in particular of the cylinders of two-stroke engines, such as two-stroke marine engines.

On the other hand, the lubricant compositions currently available do not completely and satisfactorily protect the metal parts of the engines from corrosion and/or tribocorrosion, and in particular the metal parts of the two-stroke engines against tribocorrosion, when friction is of the alternative slip type.

There is therefore a need for lubricant compositions capable to improve the protection of the metallic parts of an engine, in particular of a two-stroke engine, such as a two-stroke marine engine, against corrosion and/or tribocorrosion. There is also a need for lubricant compositions with a reduced Basicity Index.

An aim of the present invention is to provide lubricant compositions capable to improve the protection of the metallic parts of an engine, typically of a two-stroke engine, in particular of a two-stroke marine engine, against corrosion and/or tribocorrosion.

Document US2003/176299 discloses an antiwear and extreme pressure lubricant additive comprising the combination of a phosphoric ester and a sulphur compound.

Document EP3473695 discloses lubricant compositions comprising a base oil, an alkoxylated phosphate ester of an aliphatic alcohol and a non-alkoxylated phosphate ester of an aliphatic alcohol.

Surprisingly, the Applicant has discovered that the alcohol ethoxylate phosphate esters of formula (I) described hereunder have noteworthy properties as anti-corrosion additives in lubricant compositions for marine engines, particularly for two-stroke marine engines. Especially, the alcohol ethoxylate phosphate esters of formula (I) described hereunder have noteworthy properties as anti-tribocorrosion additives in lubricant compositions for marine engines, particularly for two-stroke marine engines. In addition, the alcohol ethoxylate phosphate esters of formula (I) described here-under provide lubricant compositions having a reduced Basicity Index (compared to prior art lubricant compositions).

The present invention relates more particularly to cylinder oils for two-stroke engines, in particular for two-stroke marine engines.

Still other objects and advantages will appear on reading the description of the invention which follows.

SUMMARY OF THE INVENTION

The invention concerns the use of an alcohol ethoxylated phosphate ester compound of formula (I):

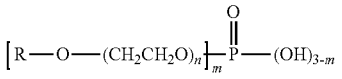

(I)

wherein

R is a linear or branched alkyl group having from 10 to 14 carbon atoms, m is an integer from 1 to 3, n is an integer superior or equal to 6 in a lubricant composition comprising at least one base oil to prevent and/or reduce and/or limit and/or delay corrosion and/or tribocorrosion of the metal parts of a combustion engine.

According to a favourite embodiment, in formula (I), m is an integer from 1 to 2.

According to a favourite embodiment, in formula (I), R is a linear alkyl group having from 10 to 14 carbon atoms. Preferably, in formula (I), R is $C_{13}$ alkyl.

According to a favourite embodiment, in formula (I), n is an integer from 6 to 14, preferably from 6 to 12, more preferably from 6 to 8.

Preferably, in formula (I): R is $C_{13}$ alkyl, n=6 and m=1 or 2.

Advantageously, the alcohol ethoxylate phosphate ester compound of formula (I) is present in the lubricant composition in an amount ranging from 0.01 to 30% by weight with regards to the total weight of the lubricant composition.

Advantageously, the lubricant composition further comprises from 3 to 40% of at least one detergent, selected from neutral and overbased detergents, the percentage being by weight with regards to the total weight of the lubricant composition.

Preferably, the lubricant composition further comprises from 0.01% to 10%, of dispersant, the percentage being by weight with regards to the total weight of the lubricant composition.

According to an aspect of the invention, the alcohol ethoxylated phosphate ester compound of formula (I), as described above and in details below, is used to passivate the metal parts of said combustion engine.

Advantageously, according to this aspect, the combustion engine is a two-stroke marine engine.

The invention also concerns a method to reduce and/or limit and/or prevent and/or delay the corrosion and/or tribocorrosion of the metal parts of a combustion engine, wherein said method comprises at least a step of application to said engine of a compound of formula (I) as described above and in details below.

Preferably, the compound of formula (I) is applied in a lubricant composition as described above and in details below.

Preferably, the combustion engine is a two-stroke marine engine.

Preferably, the metal part is a cylinder or a piston.

Preferably, the metal part is made of cast iron.

Preferably, the invention concerns a lubricant composition comprising:

from 70 to 99.99% of at least one base oil, from 0.01 to 30% of at least one alcohol ethoxylated phosphate ester compound of formula (I):

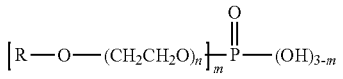

(I)

wherein

R is a linear or branched alkyl group having from 10 to 14 carbon atoms, m is an integer from 1 to 3, n is an integer superior or equal to 6.

DETAILED DESCRIPTION

The term "consists essentially of" followed by one or more characteristics, means that may be included in the process or the material of the invention, besides explicitly listed components or steps, components or steps that do not materially affect the properties and characteristics of the invention.

The expression "comprised between X and Y" includes boundaries, unless explicitly stated otherwise. This expression means that the target range includes the X and Y values, and all values from X to Y.

"Alkyl" means a saturated hydrocarbyl chain, that can be linear, branched or cyclic.

"Alkenyl" means a hydrocarbyl chain, that can be linear, branched or cyclic and comprises at least one unsaturation, preferably a carbon-carbon double bond.

"Aryl" means an aromatic hydrocarbyl functional group. This functional group can be monocyclic or polycyclic. As examples of an aryl group one can mention: phenyl, naphtalen, anthracen, phenanthren and tetracen.

"Aralkyl" means a hydrocarbyl radical comprising an aromatic hydrocarbon functional group, preferably monocyclic, linked to an alkyl chain, the aralkyl group can be linked to the rest of the molecule through the aryl or the alkyl part of the radical.

"Hydrocarbyl" means a compound or fragment of a compound selected from: an alkyl, an alkenyl, an aryl, an aralkyl. Where indicated, some hydrocarbyl groups include heteroatoms.

"alkanediyl" means a divalent radical derived from aliphatic hydrocarbons by removal of two hydrogen atoms on distinct carbon atoms.

The Alcohol Ethoxylate Phosphate Ester Compounds of Formula (I):

The alcohol ethoxylate phosphate ester compound for use according to the invention is selected from compounds of formula (I)

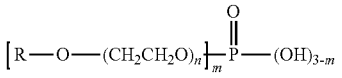

(I)

wherein

R is a linear or branched alkyl group having from 10 to 14 carbon atoms, m is an integer from 1 to 3, n is an integer superior or equal to 6.

The alcohol ethoxylate phosphate ester compound of formula (I) can be one sole compound but it can also consist of a mixture of compounds of formula (I), wherein R represent distinct groups and/or m and/or n have different values.

Advantageously, in formula (I), R is a linear alkyl group having from 10 to 14 carbon atoms. According to a favourite embodiment, R is $C_{13}$ alkyl group.

Advantageously, in the formula (I), m is 1 to 2. When m is 1, the compound of formula (I) is a phosphate monoester. When m is 2, the compound of formula (I) is a phosphate diester. According to an embodiment of the invention, the alcohol ethoxylate phosphate ester compound of formula (I) is a mixture of monoester and diester compounds.

Advantageously, in formula (I), n is an integer from 6 to 14, preferably from 6 to 12, more preferably from 6 to 8.

According to a preferred embodiment, the alcohol ethoxylate phosphate ester is tridecyl alcohol ethoxylate phosphate ester wherein n represents 6.

The alcohol ethoxylate phosphate esters of formula (I) can be prepared by any method known to the skilled professional. For example, the compounds of formula (I) may be obtained by the reaction of a phosphating agent, such as phosphoric acid, with fatty alcohol ethoxylates. Fatty alcohol ethoxylates can be based on either synthetic or natural fatty alcohols. Synthetic alcohol ethoxylates are produced by direct ethoxylation of alcohols, whereas natural fatty alcohols are first reduced to make them saturated before going for ethoxylation. The reaction product may contain residual alcohol and residual phosphoric acid in addition to the compound of formula (I) according to the invention.

The alcohol ethoxylate phosphate ester compounds of formula (I) may be in the form of their salts, e. g. amine salts or alkali or alkaline earth metal salts.

The alcohol ethoxylate phosphate ester compound of formula (I), or salts thereof, may suitably be present in the lubricant composition in an amount ranging from 0.01 to 30%, preferably from 0.1 to 30%, preferably from 0.5 to 10%, even more preferably from 1 to 8%, by weight relative to the total weight of the lubricant composition.

Base Oils

Generally, the lubricating oil compositions according to the invention comprise as a first component an oil of lubricating viscosity, also called "base oils". The base oil for use herein can be any presently known or later-discovered oil of lubricating viscosity used in formulating lubricating oil compositions for any of the following applications, e.g., engine oils, marine cylinder oils, functional fluids such as hydraulic oils, gear oils, transmission fluids, like for example automatic transmission fluids, turbine lubricants, trunk piston engine oils, compressor lubricants, metal-working lubricants, and other lubricating oil and grease compositions.

Advantageously, the lubricant compositions according to the invention are marine engine lubricating oil compositions, preferably they are two-stroke marine engine lubricating oil compositions.

Generally, the oils also called "base oils" used for formulating lubricant compositions according to the present invention may be oils of mineral, synthetic or plant origin as well as their mixtures. The mineral or synthetic oils generally used in the application belong to one of the classes defined in the API classification as summarized below:

| | Saturated substance content (weight percent) | Sulfur content (weight percent) | Viscosity Index |
|---|---|---|---|
| Group 1 Mineral oils | <90% | >0.03% | 80 ≤ VI < 120 |
| Group 2 Hydrocracked oils | ≥90% | ≤0.03% | 80 ≤ VI < 120 |
| Group 3 Hydroisomerized oils | ≥90% | ≤0.03% | ≥120 |
| Group 4 | PAOs | | |
| Group 5 | Other bases not included in the base Groups 1 to 4 | | |

These mineral oils of Group 1 may be obtained by distillation of selected naphthenic or paraffinic crude oils followed by purification of these distillates by methods such as solvent extraction, solvent or catalytic dewaxing, hydrotreating or hydrogenation.

The oils of Groups 2 and 3 are obtained by more severe purification methods, for example a combination of hydrotreating, hydrocracking, hydrogenation and catalytic dewaxing. Examples of synthetic bases of Groups 4 and 5 include poly-alpha olefins, polybutenes, polyisobutenes, alkylbenzenes.

These base oils may be used alone or as a mixture. A mineral oil may be combined with a synthetic oil.

The lubricant compositions of the invention have a viscosity grade of SAE-40 to SAE-60 according to the SAEJ300 classification, generally SAE-50 equivalent to a kinematic viscosity at 100° C. between 16.3 and 21.9 $mm^2/s$.

Grade 40 oils have a kinematic viscosity at 100° C. of between 12.5 and 16.3 $mm^2/s$.

Grade 50 oils have a kinematic viscosity at 100° C. of between 16.3 and 21.9 $mm^2/s$.

Grade 60 oils have a kinematic viscosity at 100° C. of between 21.9 and 26.1 $mm^2/s$.

According to the uses of the profession, it is preferred to formulate cylinder oils for two-stroke diesel marine engines having a kinematic viscosity at 100° C. of between 18 and 21.5 $mm^2/s$, preferably between 19 and 21.5 $mm^2/s$.

This viscosity can be obtained by mixing additives and base oils, for example containing Group 1 mineral bases such as Neutral Solvent bases (for example 500 NS or 600 NS) and Brightstock. Any other combination of mineral, synthetic or vegetable base having, when mixed with the additives, a viscosity compatible with the SAE-50 grade can be used.

Typically, a conventional formulation of cylinder lubricant for slow 2-stroke marine diesel engines is of grade SAE-40 to SAE-60, preferably SAE-50 (according to the classification SAE J300) and comprises at least 50% by weight of lubricant base of mineral and/or synthetic origin, suitable for use in a marine engine, for example, of API group 1 class, that is to say obtained by distillation of selected crudes followed by the purification of these distillates by processes such as solvent extraction, solvent or catalytic dewaxing, hydrotreatment or hydrogenation. Their Viscosity Index (VI) is between 80 and 120, their sulfur content is greater than 0.03% and their saturated content is less than 90%

Advantageously, the lubricating composition according to the invention comprises at least 50% by weight of base oil(s) relative to the total weight of the composition.

More advantageously, the lubricant composition according to the invention comprises at least 60% by weight, or even better at least 70% by weight, of base oil(s) relative to the total weight of the composition.

More particularly, the lubricant composition according to the invention comprises from 60% to 99.99% by weight of base oils, preferably from 70% to 98% by weight of base oils, relative to the total weight of the composition.

Detergents and Dispersants

Preferably, the lubricant composition according to the invention further comprises at least one additive chosen from detergents, dispersants and their mixtures.

The detergents used in the lubricant compositions according to the present invention are well known to those skilled in the art.

In the context of the present invention, the detergents commonly used in the formulation of lubricating compositions are anionic compounds comprising a long lipophilic hydrocarbon chain and a hydrophilic head. The associated cation is a metal cation of an alkali or alkaline earth metal.

The detergents are preferably chosen from the alkali or alkaline earth metal salts of carboxylic acids, sulfonates, salicylates, naphthenates, as well as the phenate salts. The alkali and alkaline earth metals are preferably calcium, magnesium, sodium or barium.

These metal salts may contain the metal in an approximately stoichiometric amount relative to the anion group(s) of the detergent. In this case, one refers to non-overbased or "neutral" detergents, although they also contribute to a certain basicity. These "neutral" detergents typically have a BN measured according to ASTM D2896, of less than 150 mg KOH/g, or less than 100 mg KOH/g, or less than 80 mg KOH/g of detergent.

This type of so-called neutral detergent may contribute in part to the BN of lubricating compositions. For example, neutral detergents are used such as carboxylates, sulphonates, salicylates, phenates, naphthenates of the alkali and alkaline earth metals, for example calcium, sodium, magnesium, barium.

When the metal is in excess (amount greater than the stoichiometric amount relative to the anion groups(s) of the detergent), then these are so-called overbased detergents. Their BN is high, higher than 150 mg KOH/g of detergent, typically from 200 to 700 mg KOH/g of detergent, preferably from 250 to 450 mg KOH/g of detergent.

The metal in excess providing the character of an overbased detergent is in the form of insoluble metal salts in oil, for example carbonate, hydroxide, oxalate, acetate, glutamate, preferably carbonate.

In one overbased detergent, the metals of these insoluble salts may be the same as, or different from, those of the oil soluble detergents. They are preferably selected from calcium, magnesium, sodium or barium.

The overbased detergents are thus in the form of micelles composed of insoluble metal salts that are maintained in suspension in the lubricating composition by the detergents in the form of soluble metal salts in the oil. These micelles may contain one or more types of insoluble metal salts, stabilised by one or more types of detergent.

The overbased detergents comprising a single type of detergent-soluble metal salt are generally named according to the nature of the hydrophobic chain of the latter detergent. Thus, they will be called a phenate, salicylate, sulphonate, naphthenate type when the detergent is respectively a phenate, salicylate, sulphonate or naphthenate.

The overbased detergents are called mixed type if the micelles comprise several types of detergents, which are different from one another by the nature of their hydrophobic chain. The overbased detergent and the neutral detergent may be selected from carboxylates, sulphonates, salicylates, naphthenates, phenates and mixed detergents combining at least two of these types of detergents. The overbased detergents and the neutral detergents include compounds based on metals selected from calcium, magnesium, sodium or barium, preferably calcium or magnesium. The overbased detergent may be overbased by metal insoluble salts selected from the group of carbonates of alkali and alkaline earth metals, preferably calcium carbonate. The lubricating composition may comprise at least one overbased detergent and at least a neutral detergent as defined above.

Advantageously, the composition according to the invention comprises from 3 to 40% weight detergent, more advantageously from 5 to 30%, preferably from 10 to 25%, these percentages being by weight of detergent, with regards to the total weight of the lubricant composition.

Preferably, the composition according to the invention comprises from 3 to 40% weight detergent, more advantageously from 5 to 30%, preferably from 10 to 25%, these percentages being by weight of neutral and overbased detergent, with regards to the total weight of the lubricant composition, preferably selected from neutral and overbased detergents having a Total Base Number according to ASTM D2896 of from 20 to 450 mg KOH/g.

Advantageously, the percentage by weight of neutral and overbased detergents relative to the total weight of lubricant is chosen such that the BN provided by the neutral and overbased detergents represents a contribution of at most 70 milligrams of potash per gram of lubricant, preferably from 5 to 70 milligrams of potash per gram of lubricant, more preferably from 20 to 40 milligrams of potash per gram of lubricant, to the total BN of said lubricant composition.

Dispersants are well known additives used in the formulation of lubricating compositions, in particular marine engine lubricating compositions. Their primary role is to maintain in suspension the particles initially present or appearing in the lubricating composition during its use in the engine. They prevent their agglomeration by playing on steric hindrance. They can also have a synergistic effect on neutralization.

In the context of the present invention, the dispersants used as lubricant additives contain a polar group, associated with a relatively long hydrocarbon chain, generally containing from 50 to 400 carbon atoms. The polar group typically contains at least one nitrogen or oxygen element.

Compounds derived from succinic acid are dispersants particularly used as lubrication additives. Of particular interest in the compositions according to the invention are: succinimides, obtained by condensation of succinic anhydrides and amines, and succinic esters obtained by condensation of succinic anhydrides and alcohols or polyols.

These compounds can then be treated with various compounds, including sulfur, oxygen, formaldehyde, carboxylic acids and compounds containing boron or zinc to produce, for example, borated succinimides or zinc blocked succinimides.

Mannich bases, obtained by polycondensation of phenols substituted by alkyl groups, formaldehyde and primary or secondary amines, are also compounds used as dispersants in lubricants.

Preferably, the dispersants according to the invention are chosen from succinimides, such as polyisobutylenes bis-succinimides, optionally borated or blocked with zinc.

Advantageously, the lubricant composition according to the invention can comprise from 0.01% to 10%, preferably from 0.1% to 5%, advantageously from 0.5% to 3% by weight of dispersant (s) relative to the total weight of the lubricating composition.

Advantageously, the lubricant composition according to the invention can comprise from 0.01% to 10%, preferably from 0.1% to 5%, advantageously from 0.5% to 3% by weight of succinimides, such as polyisobutylenes bis-succinimides, relative to the total weight of the lubricating composition.

Other Additives:

The lubricant composition of the invention may comprise at least one optional additive, chosen in particular from among those frequently used by persons skilled in the art.

In one embodiment, the lubricant composition further comprises an optional additive chosen amongst an anti-wear additive, an oil soluble fatty amine, a polymer, a dispersing additive, an anti-foaming additive or a mixture thereof.

Polymers are typically polymers having a low molecular weight of from 2000 to 50 000 Dalton ($M_n$). The polymers are selected amongst PIB (of from 2000 Dalton), polyacrylates or polymetacrylates (of from 30 000 Dalton), olefin copolymers, olefin and alpha-olefin copolymers, EPDM, polybutenes, poly alpha-olefin having a high molecular weight (viscosity 100° C.>150), hydrogenated or non-hydrogenated styrene-olefin copolymers. Polymers can be used as thickening additives whose role is to increase both the hot and cold viscosity of the composition, and/or to improve the viscosity index (VI).

Anti-wear additives protect the surfaces from friction by forming a protective film adsorbed on these surfaces. The most commonly used is zinc dithiophosphate or ZnDTP. Also, in this category, there are various phosphorus, sulphur, nitrogen, chlorine and boron compounds. There are a wide variety of anti-wear additives, but the most widely used category is that of the sulphur phospho additives such as metal alkylthiophosphates, especially zinc alkylthiophosphates, more specifically, zinc dialkyl dithiophosphates or ZnDTP. The preferred compounds are those of the formula $Zn((SP(S)(OR_1)(OR_2))_2$, wherein $R_1$ and $R_2$ are alkyl groups, preferably having 1 to 18 carbon atoms. The ZnDTP is typically present at levels of about 0.1 to 2% by weight relative to the total weight of the lubricating composition. The amine phosphates, polysulphides, including sulphurised olefins, are also widely used anti-wear additives. One also optionally finds nitrogen and sulphur type anti-wear and extreme pressure additives in lubricating compositions, such as, for example, metal dithiocarbamates, particularly molybdenum dithiocarbamate. Glycerol esters are also anti-wear additives. Mention may be made of mono-, di- and trioleates, monopalmitates and monomyristates. In one embodiment, the content of anti-wear additives ranges from 0.01 to 6%, preferably from 0.1 to 4% by weight relative to the total weight of the lubricating composition.

Also commonly encountered in lubricating compositions are anti-wear and extreme pressure additives of nitrogen and sulfur type, such as for example metal dithiocarbamates, in particular molybdenum dithiocarbamate. Glycerol esters are also anti-wear additives. Mention may be made, for example, of mono, di- and trioleates, monopalmitates and monomyristates.

The lubricating composition according to the invention can further comprise all types of functional additives suitable for its use, for example:

- anti-foam additives which can be for example polar polymers such as polymethylsiloxanes, polyacrylates,
- anti-oxidant additives, for example of phenolic or amino type, and/or
- antioxidant and/or anti-rust additives, for example organometallic or thiadiazole compounds.

These additives are known to persons skilled in the art. These additives are generally present in a weight content of 0.01 to 5% based on the total weight of the lubricating composition.

In one embodiment, the lubricant composition according to the invention may further comprise an oil soluble fatty amine.

The optional additives such as defined above contained in the lubricant compositions of the present invention can be incorporated in the lubricant composition as separate additives, in particular through separate addition thereof in the base oils. However, they may also be integrated in a concentrate of additives for marine lubricant compositions.

Lubricant Composition

The invention is further directed to some lubricant compositions for two stroke and four stroke marine engines comprising such additives.

Advantageously, the lubricant composition comprises, preferably consists essentially of:

- from 70.0 to 99.99% of at least one base oil,
- from 0.01 to 30.0% of at least one compound of formula (I) as defined above
- the percentages being defined by weight of component as compared to the total weight of the composition.

According to a particular embodiment, the lubricating composition comprises, preferably consists essentially of:

from 50% to 96.9% by weight, preferably from 60 to 95% by weight, more preferably from 70 to 90% by weight, of one or more base oil(s), from 0.01% to 30% by weight, preferably from 0.5 to 20% by weight, more preferably from 1 to 10% by weight, of one or more compounds of formula (I), and from 3% to 40% by weight, preferably from 5 to 30% by weight, more preferably from 10% to 25% by weight, of one or more detergent(s) selected from neutral and overbased detergents having a Total Base Number according to ASTM D2896 of from 20 to 450 mg KOH/g, and optionally from 0.01% to 10% by weight, preferably from 0.1 to 5% by weight, more preferably from 0.5% to 3% by weight, of one or more dispersant(s), the percentages being defined by weight of component as compared to the total weight of the composition.

According to another particular embodiment, the lubricating composition comprises, preferably consists essentially of:

from 50 to 99% by weight, preferably from 60 to 95% by weight, more preferably from 70 to 90% by weight, of base oil (s), from 0.01 to 30% by weight, preferably from 0.5 to 20% by weight, more preferably from 1 to 10% by weight, of one or more compounds of formula (I), and from 0.01 to 10% by weight, preferably from 0.1 to 5% by weight, more preferably from 0.5 to 3% by weight, of dispersant(s), and optionally from 3 to 40% by weight, preferably from 5 to 30% by weight, more preferably from 10 to 25% by weight, of detergent(s) selected from neutral and overbased detergents having a Total Base Number according to ASTM D2896 of from 20 to 450 mg KOH/g, the percentages being defined by weight of component as compared to the total weight of the composition.

Method for Producing a Lubricant Composition

The present disclosure provides a method for producing a lubricant composition, especially a marine lubricant, as disclosed above, comprising the step of mixing the base oil with the component of formula (I) as above defined, and optionally the additives.

Properties of the Lubricant Composition

The components that have been disclosed above are formulated to provide a composition that advantageously has the following characteristics:

Advantageously, the composition has a Total Base Number (TBN) value according to ASTM D2896 of above 5 mg KOH/g. Preferably, the composition has a Total Base Number (TBN) value of from 10 to 140 mg KOH/g, better from 15 to 75 mg KOH/g, more preferably from 20 to 60 mg KOH/g.

Preferably, the lubricant composition according to the invention has a kinematic viscosity at 100° C. superior or equal to 5.6 $mm^2/s$ and inferior or equal to 21.9 $mm^2/s$, preferably superior or equal to 12.5 $mm^2/s$ and inferior or equal to 21.9 $mm^2/s$, more preferably superior or equal to 14.3 $mm^2/s$ and inferior or equal to 21.9 $mm^2/s$, advantageously comprised between 16.3 and 21.9 $mm^2/s$, wherein kinematic viscosity at 100° C. is evaluated according to ASTM D 445.

Preferably, the lubricant composition according to the invention is a cylinder lubricant.

Even more advantageously, the lubricating composition is a cylinder oil for two-stroke diesel marine engines and has a viscosimetric grade SAE-50, equivalent to a kinematic viscosity at 100° C. comprised between 16.3 and 21.9 $mm^2/s$ wherein kinematic viscosity at 100° C. is evaluated according to ASTM D 445.

Typically, a conventional formulation of cylinder lubricant for two-stroke marine diesel engines is of grade SAE 40 to SAE 60, preferentially SAE 50 (according to the SAE J300 classification) and comprises at least 50% by weight of a lubricating base oil of mineral and/or synthetic origin, adapted to the use in a marine engine, for example of the API Group 1 class.

These viscosities may be obtained by mixing additives and base oils, for example base oils containing mineral bases of Group 1 such as Neutral Solvent (for example 150 NS, 500 NS or 600 NS) bases and bright stock. Any other combination of mineral, synthetic bases or bases of plant origin, having, as a mixture with the additives, a viscosity compatible with the chosen SAE grade, may be used.

Use of the Compound of Formula (I) and of the Lubricant Composition Comprising it The invention relates to the use of a compound of formula (I) as defined above for lubricating engines, preferably marine engines. Specifically, the invention is directed to the use of a compound of formula (I) as defined above for lubricating two-stroke marine engines and four-stroke marine engines, more preferably two-stroke marine engines.

In particular, the compound of formula (I) is suitable for use in a lubricant composition, as cylinder oil or system oil, for lubricating two-stroke and four-stroke marine engines, more preferably two-stroke marine engines.

In particular, the compound of formula (I) is used in marine engines, preferably two-stroke marine engines, to prevent and/or reduce and/or limit and/or delay corrosion and/or tribocorrosion of the metal parts of said engine.

For the purposes of the present invention, "corrosion" means an alteration of a material, preferably metallic, resulting from chemical reaction with an oxidant. Generally, this oxidant is an acid. Most frequently, this acid is sulfuric acid $H_2SO_4$.

For the purposes of the present invention, the term "tribocorrosion" means a process leading to the degradation and wear of a metallic material under the combined action of friction and corrosion as defined above.

Corrosion and tribocorrosion are evaluated by the methods disclosed in the experimental part. Alternately, they can be quantified by any method known to the skilled professional.

Further, the compound of formula (I) is used in marine engines, preferably two-stroke marine engines, to passivate the metal parts of said engine.

For the purposes of the present invention, "passivate metal parts" means an operation of protecting metal parts against corrosion leading to a material becoming "passive," that is, less affected or less corroded by the environment of future use.

The invention also relates to the use of the above-described lubricant composition comprising the compound of formula (I) and a base oil, for lubricating two-stroke marine engines and four-stroke marine engines, more preferably two-stroke marine engines.

In particular, the above-described lubricant composition is used in marine engines, preferably two-stroke marine engines, to prevent and/or reduce and/or limit and/or delay corrosion and/or tribocorrosion of the metal parts of said engine.

Further, the above-described lubricant composition is used in marine engines, preferably two-stroke marine engines, to passivate the metal parts of said engine.

The invention also relates to a method for lubricating two-stroke marine engines and four-stroke marine engines, more preferably two-stroke marine engines, said method comprising the application to said marine engine of the compound of formula (I) or of a lubricant composition as disclosed above.

The invention particularly relates to a method to reduce and/or limit and/or prevent and/or delay the corrosion and/or tribocorrosion of the metal parts of a combustion engine, wherein said method comprises at least a step of application to said engine of a compound of formula (I) or of a lubricant composition as disclosed above.

In particular, the compound of formula (I) or the lubricant composition comprising it is applied to the cylinder wall, typically by a pulse lubricating system or by spraying the compound or the composition onto the piston's rings pack through an injector for lubricating two-stroke engines. It has been observed that applying to the cylinder wall the compound or the lubricant composition according to the invention provides increased protection against corrosion and tribocorrosion.

Preferably, the metal part protected by the compound or the composition according to the invention is a cylinder or a piston.

Advantageously, the metal part is made of cast iron.

Preferably, the engine is an engine consuming heavy fuel oil. By "heavy fuel oil" is meant in the sense of the present invention the heavy cuts resulting from the distillation of petroleum, possibly comprising additives.

Advantageously, the compound of formula (I) defined in the present invention is used in a cylinder lubricating composition to reduce acid tribocorrosion on the cylinders and pistons of a two-stroke engine, such as a two-stroke marine engine.

The invention also relates to a method for passivating metal parts of an engine, in particular a two-stroke engine, such as a two-stroke marine engine, wherein said method comprises at least a step of application to said engine of a compound of formula (I) or of a lubricant composition as disclosed above.

EXAMPLES

I—Material and Methods:

IA—Chemicals

The list of additives and their characteristics is provided in Table 1:

TABLE 1

| | Chemical name | BN |
|---|---|---|
| A1 | Alcohol ethoxylated phosphate ester (CAS No 865764-15-4) | 0 |
| A2 | Tridecyl Alcohol Ethoxylate Phosphate Ester (CAS No 78330-24-2) | 0 |

Base oil 1: Group I mineral oil 600NS having a viscosity at 40° C. of 112 cSt measured according to ASTM D7279

Base oil 2: Group I mineral oil BSS having a viscosity at 40° C. of 500 cSt measured according to ASTM D7279

Additive package comprising dispersant(s), detergent(s) and/or anti-foaming component(s).

IB—Characteristics

TBN is the Total base number in mg KOH/g of composition according to ASTM D2896.

II—Preparation of the Lubricant Composition:

Lubricant compositions are prepared by mixing the base oil with the additives listed in Table 2 below at 60° C. with the corresponding proportions. The amounts correspond to weight percent with regards to the total weight of the composition.

Compositions C1 to C2 are comparative examples. C1 is also a reference example. Composition C3 is according to the invention.

TABLE 2 formulation of lubricant compositions

| Composition | C1/ref | C2 | C3 |
|---|---|---|---|
| Base oil 1 = 600NS | 54 | 54 | 54 |
| Base oil 2 = BSS | 34.6 | 33.6 | 33.6 |
| Additive Package | 11.4 | 11.4 | 11.4 |
| A1 | — | 1 | — |
| A2 | — | — | 1 |
| Total by weight | 100 | 100 | 100 |
| TBN (in mg KOH/g of composition) | 25 | 25 | 25 |

III—Test Methods:

III.A—Test Method 1:

The internal apparatus used to evaluate the passivation of the compounds tested consists of a beaker of suitable size (usually 500 to 1000 mL), a temperature-regulating device such as a hot plate, and a specimen support system. 200 mL of lubricant are continuously mixed by a suitable stirring mechanism, such as a magnetic stirrer or others. Using a dosing syringe or pump, a well-defined amount of sulfuric acid is added to the lubricant drop by drop, to expose the metallic test samples to severely acidic corrosive conditions. The quantity of sulfuric acid is determined to have 90% of the TBN of the oil neutralized.

The effects of corrosion are determined by visual changes on the metallic specimen.

IV—Results:

The results obtained with compositions C1 to C3 described above are shown in Table 3 below. Corrosion is rated on a scale of 1 to 5: "1" means that the test sample is very corroded and "5" means it is hardly corroded or not corroded at all.

TABLE 3 results of corrosion tests

| Composition | C1 | C2 | C3 |
|---|---|---|---|
| Corrosion note | 2 | 4 | 5 |

The invention claimed is:

1. A method to reduce and/or limit and/or prevent and/or delay corrosion and/or tribocorrosion of metal parts of a combustion engine, wherein said method comprises at least steps of:

a) providing a compound of formula (I):

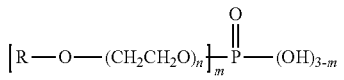

(I)

wherein

R is a linear or branched alkyl group having from 10 to 14 carbon atoms, m is an integer from 1 to 3, n is an integer superior or equal to 6, and b) applying the compound of formula (I) to the metal parts of the combustion engine, wherein said compound of formula (I) reduces and/or limits and/or prevents and/or delays the corrosion and/or tribocorrosion of the metal parts.

2. The method according to claim 1, wherein in formula (I) R is a linear alkyl group having from 10 to 14 carbon atoms.

3. The method according to claim 1, wherein in formula (I) R is C13 alkyl.

4. The method according to claim 1, wherein in formula (I), n is an integer from 6 to 14.

5. The method according to claim 4, wherein in formula (I), n is an integer from 6 to 12.

6. The method according to claim 5, wherein in formula (I), n is an integer from 6 to 8.

7. The method according to claim 6, wherein in formula (I): R is C13 alkyl, n =6 and m=1 or 2.

8. The method according to claim 1 to passivate the metal parts of the combustion engine.

9. The method according to claim 1, wherein the engine is a two-stroke marine engine.

10. The method according to claim 1, wherein the metal part is a cylinder or a piston.

11. The method according to claim 1, wherein the metal part is made of cast iron.

12. The method according to claim 1, wherein the compound of formula (I) is present in a lubricant composition comprising at least a base oil.

13. The method according to claim 12, wherein the compound of formula (I) is present in the lubricant composition in an amount ranging from 0.01 to 30% by weight relative to the total weight of the lubricant composition.

14. The method according to claim 13, wherein the lubricant composition further comprises from 3 to 40% of at least one detergent, selected from neutral and overbased detergents, the percentage being by weight relative to the total weight of the lubricant composition.

15. The method according to claim 13, wherein the lubricant composition further comprises from 0.01% to 10%, of dispersant, the percentage being by weight relative to the total weight of the lubricant composition.

* * * * *